United States Patent [19]

Schinko

[11] 4,157,065

[45] Jun. 5, 1979

[54] JUICE EXTRACTOR

[76] Inventor: Konrad Schinko, Hanlons Rd., Bilpin, New South Wales, Australia, 2758

[21] Appl. No.: 687,862

[22] Filed: May 19, 1976

[30] Foreign Application Priority Data

Sep. 16, 1975 [AU] Australia ..... PC3180

[51] Int. Cl.[2] ..... B30B 15/30; B30B 9/20; B30B 9/24

[52] U.S. Cl. ..... 100/45; 100/120; 100/153

[58] Field of Search ..... 100/118-120, 100/151-154, 37, 45, 47; 137/558; 198/505; 222/55

[56] References Cited

U.S. PATENT DOCUMENTS

| | | | |
|---|---|---|---|
| 271,387 | 1/1883 | Wilcox | 100/120 |
| 432,153 | 7/1890 | Whiting | 100/118 |
| 2,365,658 | 12/1944 | Schumacher | 100/154 |
| 2,846,944 | 8/1958 | Willmes et al. | 100/153 |
| 3,464,437 | 9/1969 | Zane | 137/558 |
| 3,805,692 | 4/1974 | Fischer | 100/120 |
| 3,897,868 | 8/1975 | Smith, Jr. | 198/505 |

FOREIGN PATENT DOCUMENTS

| | | | |
|---|---|---|---|
| 2111526 | 9/1971 | Fed. Rep. of Germany | 100/118 |

*Primary Examiner*—Harvey C. Hornsby
*Assistant Examiner*—Timothy F. Simone
*Attorney, Agent, or Firm*—D. Paul Weaver

[57] ABSTRACT

This invention relates to apparatus for use in extracting liquid from materials, said apparatus comprising means for depositing a constant supply of said materials onto a constantly moving continuous belt like element, means adapted to apply sufficient force to said materials on said element to extract liquid therefrom, means to receive said liquid and second means to receive the residual material from said belt like element.

1 Claim, 8 Drawing Figures

JUICE EXTRACTOR

FIELD OF THE INVENTION

This invention relates to the extraction of liquid from materials and is particularly useful for extracting natural juices from fruit and vegetable foodstuffs.

Natural foodstuffs such as apples, oranges, pears and like citrus and pit fruits and certain vegetables contain juices which are consumed in large quantities by the public.

Many years ago the juices were extracted from the foodstuffs by the consumers. More recently however, it has become the fashion to purchase the required juices in containers from a supplier. Due to high labour content and inflation the cost of the manufactured article has risen to a stage where it has become necessary to reduce costs or price the article from the market.

Various manufacturers have taken steps to reduce their costs by mechanising certain parts of their production processes thus reducing the labour content. Design procedures however, have revolved about the conventional hydraulic press apparatus which cannot be automated beyond a certain point. Thus production efficiency cannot be increased sufficiently to cope with the inflationary spiral and the increased demands for more wages by the work force.

The production of liquid foodstuffs of the aforementioned type require a number of process steps of the following general type:

1. At least partly cut the fruit to ensure low resistance to crushing.
2. Press the cut fruit to squeeze the juice out.
3. Remove unwanted must from the juice.
4. Process the juice to the manufacturer's requirements.
5. Pack the resultant product in containers.
6. Remove and dispose of residue material.

Step one of the above is usually carried out at a remote plant location, the cut fruit being transported to a pressing location by vehicular or conveyor means.

Step two of the above process is usually a totally separate operation. Likewise steps three to six are generally accepted as being individual steps performed at remote locations.

There is a basic problem in combining all the method steps into a continuous process in that the type of equipment available does not lend itself to continuous production methods.

THE PRIOR ART

The basic problem involved in establishing continuous process lines revolves about the type of equipment available.

The known equipment usually operates on the established principles of hydromechanical compression of the foodstuff. An example of this equipment may be found in the conventional wire press. This press comprises a box like structure into which the cut fruit is placed. Compression of this fruit is achieved by the means of a plate which compacts the fruit to force the juice from the flesh.

This type of equipment is defective in that it is only capable of applying pressure until the fruit and its juice occupies the smallest possible area. Thereafter the juice must be allowed to drain in a vat or like drainage equipment. This type of equipment cannot possibly remove all the available juice from the fruit and is not suitable for a continuous production routine.

A further method of extracting the juice is by means of a hydraulic press in which the crushed fruit is compressed in a press box to force the juice exuding therefrom through outlet means into receptacle means. This type of equipment, although more efficient than earlier types of equipment, is still cyclic in operation and therefore limited in operational efficiency.

BROAD DISCUSSION OF THE INVENTION

The present invention overcomes the main problem of the prior art by providing an apparatus which is substantially capable of processing a continuous supply of cut or partially cut fruit without the need for the process to be stopped to remove the residue material or the product.

The invention in its broadest form comprises a hub having a perforate peripheral wall. The hub is rotatably driven at a speed selected in accordance with the rate at which the juice is removed from the fruit or food plant.

The fruit to be processed is deposited in a substantially even layer on a continuous belt which passes around the peripheral wall of the hub. The belt, which is perforate feeds the fruit onto the peripheral wall of the hub at the uppermost point thereof from whence it is carried by the belt through a circular compression stage which compresses the fruit to extract the juice. The extracted juice passes through the perforate belt and wall to pass under gravity into a container from which it is ultimately pumped to a further processing stage.

The residual material or must as it is often called is carried by the belt past the compression stage to a point at which it is released from the belt to fall into a second container or onto a conveyor by which it is removed to a disposal point.

It is therefore an object of the invention to provide a substantially continuous process for extracting juice from fruit and like market produce.

It is a further object of the invention to provide an apparatus for extracting juice from fruit and like market produce which is substantially free from the defects of the prior art.

DESCRIPTION OF THE DRAWINGS

The concept of the invention may be realised in several different constructions and should not be construed as being limited to the two embodiments which will hereinafter be described with reference to the accompanying drawings of which.

THE FIRST EMBODIMENT

Figure 1:
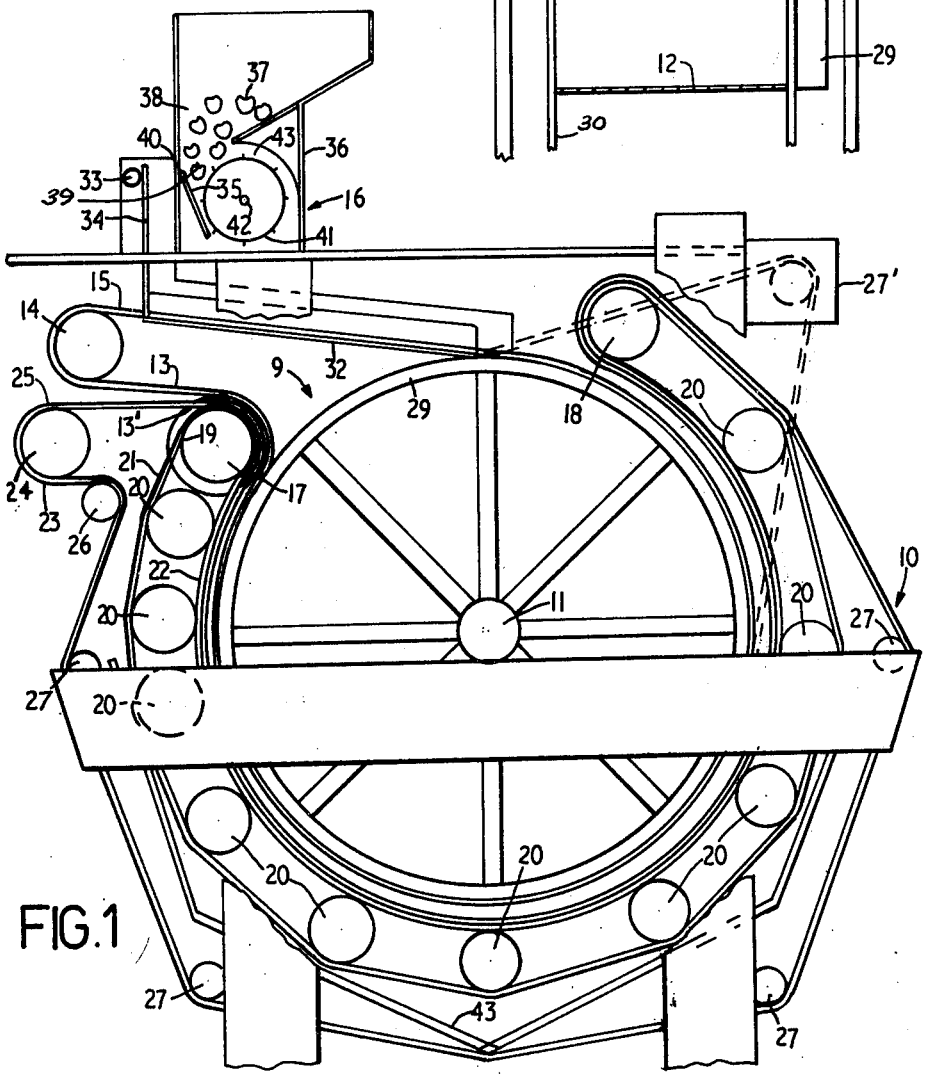
FIG. 1 is a side elevation of one embodiment of the invention.

Referring now to FIG. 1 the extractor comprises a drum like member 9 mounted on a framework 10 for rotation about a coaxial axle member 11. The axle member 11 is secured to the framework 10 by bearings (not shown) which preferably are sealed against the intrusion of foreign matter.

The drum like member 9 preferably has a perforated peripheral surface 12 upon which is mounted a fluid pervious continuous flexible belt like member 13. This member 13 has a length sufficiently longer than the circumference of the surface 12 to allow it to be passed over guide 13' and tension roll 14 to provide a lead or conveyor portion 15 onto which cut produce may be fed from a hopper 16.

Mounted within the guide 13' is a second roller 17 which in conjunction with a third roller 18 provides the means by which a second resilient fluid pervious or perforate continuous belt like member 19 is tensioned about the drum like member 9.

A plurality of second rollers 20 provide the means by which the returning portion 21 of the belt like member 19 is maintained in spaced relationship to the feeding portion 22. The rollers 20 perform a further function in that they support the feeding portion 22 of the belt like member 19 against outward deflection under the influence of crushed produce passing over the surface 12 of the drum like member 9 on the first belt like member 13.

A third continuous belt like member 23 is disposed about the drum like member 9 in superimposed relationship to the belt like member 19. The belt like member 23 is sufficiently longer than the second belt like member 19 to enable it to pass over the roller 17 and a further roller 24 to form a discharge conveyor portion 25.

Preferably the belt like member 23 is diverted, on its return path, to pass over jockey and tension rollers 26 and 27 to avoid coagulation problems. This may be further enhanced by the provision of scraper means (not shown) located between the rollers 24 and 26.

The juice extractor is driven by a suitable drive device such as an electric motor 27' via a chain or belt 28 engaging with a pulley portion, sprocket teeth or pegs (not shown) on a peripheral portion 29 of the drum like member 9.

Figure 2:
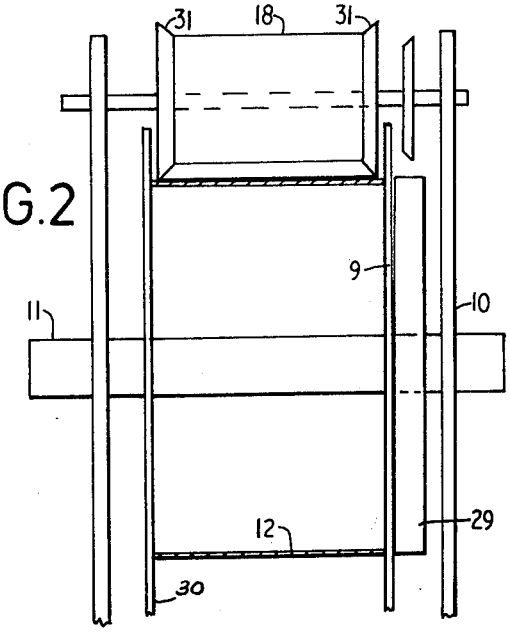
FIG. 2 is a part sectional view of a part of the embodiment of FIG. 1 showing the relationship between some of the important parts of the apparatus.

Preferably the drum like member 9 is provided with side walls 30 as shown in FIG. 2 to prevent the produce pulp from oozing out from between the belt like members 19 and 23.

Additionally the roller 18 is preferably provided with divergent side walls 31 to urge the pulp towards the centre of the belt like members 19 and 23.

In the process of extracting the juice from large quantities of produce the speed of operation of a continuous feeding and squeezing device is important. Basically it is easier to extract the juice from hard produce than it is to extract it from soft produce. This is particularly so with apples. With a constant squeezing pressure or tension on the rollers and belt like members the volume of pulped fruit per foot of travel of the belt like members is varied according to the texture or condition of the fruit.

Although the volume of the pulp fed onto the conveyor portion 15 (FIG. 1) may be varied according to the condition of the pulp it is preferable that the rotational speed of the drum like member 9 be varied. This may be achieved in a number of ways such as, for example, a detector roll of predetermined weight located over the lead conveyor portion 15 and adapted to be lifted by the fruit pulp passing therebeneath.

This roller will, by virtue of its weight, attempt to squeeze the pulp passing under it. This squeezing action will be subjected to a greater resistance with hard fruit than with soft fruit. Thus if the roller is connected to a potentiometer device to control the power source to the motor 27' the operational speed of the extractor may be controlled according to the condition of the fruit.

Alternatively the lead conveyor may be provided with a deflection detector 32 (FIG. 1) coupled to a potentiometer 33 by link means 34. By virtue of the fact that there is a weight difference between hard and soft fruit the potentiometer will control the speed of the extractor.

Another method of controlling the speed of the extractor may be to couple speed control means to deflector plate 35 of a fruit crusher 36 disposed at the inlet side of the hopper 16.

In use produce is fed into hopper 16 from a conventional conveyor or by any other suitable means. The produce 37, under the influence of its own weight, will pass downwardly through opening 38 into a pre-treatment zone 39. The pre-treatment zone 39 contains the flap 35 which is hinged at 40 and resiliently biased towards a cylindrical member 41.

The cylindrical member 41 which is mounted for rotation about an axis 42 has a plurality of cutting elements 43 disposed at spaced intervals about its periphery. Thus as the produce 37 passes into the pre-treatment zone 39 it is urged into contact with the member 41 by the flap 35 so that as the member 41 is rotated the cutting elements 43 cut the produce to reduce its resistance to compression.

The partially cut produce 37 passes in a substantially continuous flow from the pre-treatment zone onto the lead portion 15 of belt 13 because belt 13 is moving at a substantially constant speed the produce will be deposited on the surface thereof in a substantially constant layer. As the belt 13 moves it carries to produce onto the member 9 and beneath belt 23.

Because the spacing between the rollers 18, 20 and 19 and the peripheral surface of the member 9 progressively decreases the produce on the belt 13 is subjected to a progressively increasing pressure reducing it to a pulp and squeezing the natural juices therefrom.

Because the surface 12 of the member 9 and the belts 13, 21 and 23 are pervious the juices squeezed from the produce will drain downwardly into trough 43' from where it is removed to the next process stage.

THE SECOND EMBODIMENT

The second and most preferred embodiment of the invention is illustrated in FIGS. 3 to 7.

Figure 3:
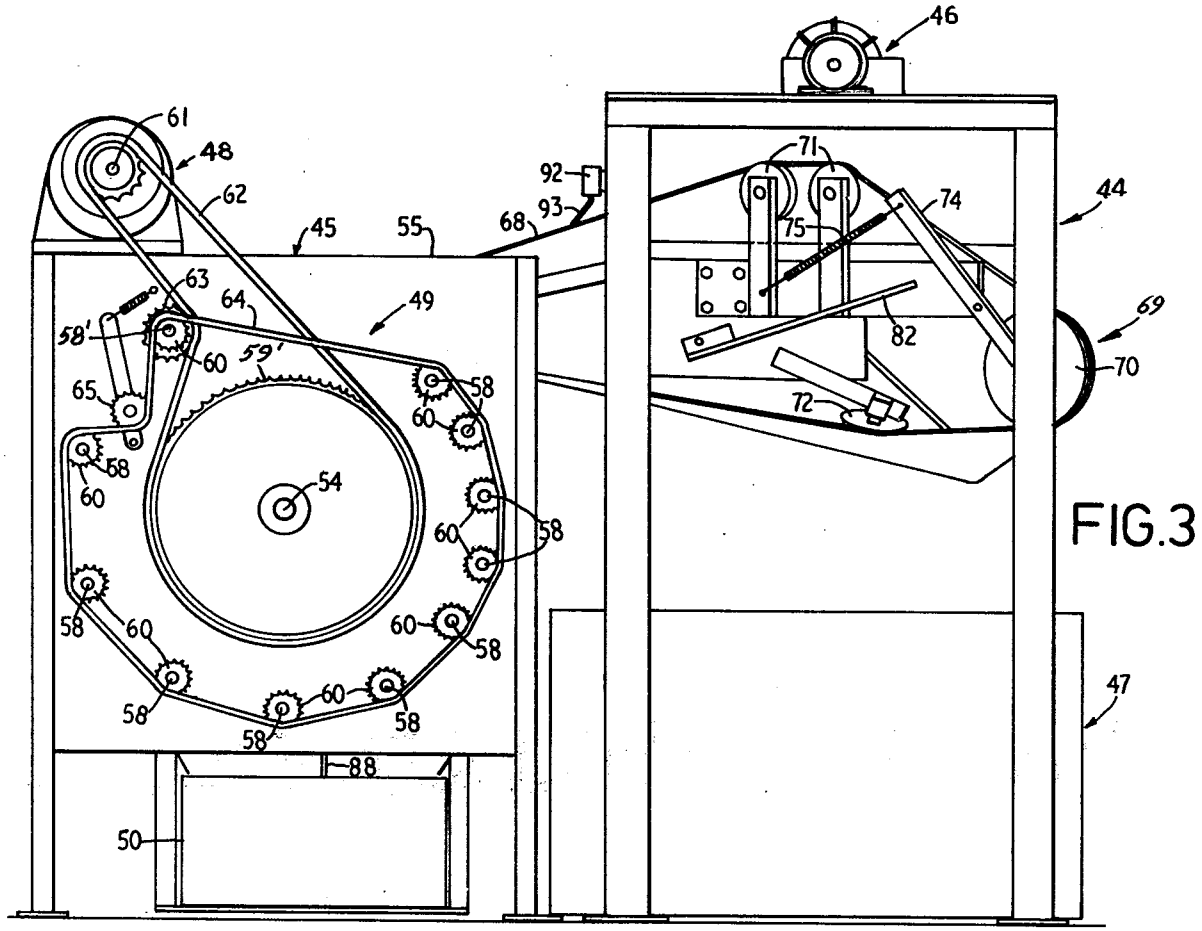
FIG. 3 is a side elevation of another embodiment of the invention.

As shown in FIG. 3 this embodiment of the invention comprises first and second support frames 44 and 45 respectively. Support frame 44 contains a supply source 46 and a pulp collection station 47 while support frame 45 contains the drive medium 48, processing elements, generally labelled 49, and juice collection station 50.

In this embodiment the invention is provided with a single main belt 51 which has sufficient continuous length to enable it to be mounted on a drum like member 52 with a lead portion 53 thereof located in the first support frame 44 beneath the supply source 46.

Figure 4:
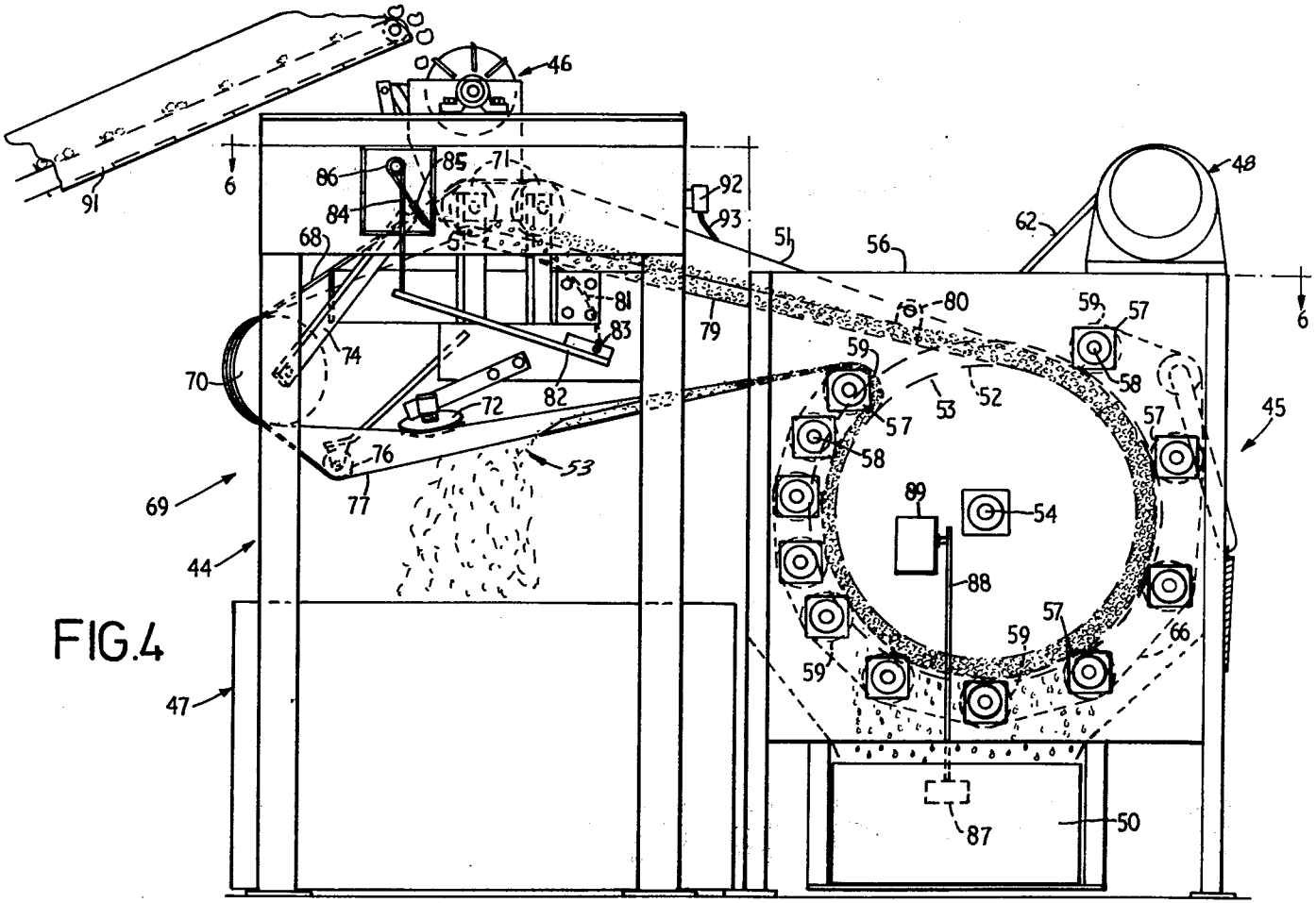
FIG. 4 is an elevation taken at the opposite side of the apparatus of FIG. 3.

The drum like member 52, the peripheral wall 53' of which may be pervious or non-pervious, is fixedly mounted on a shaft 54 which is rotatably supported in bearing means located on side walls 55 (FIG. 3) and 56 (FIG. 4). Also the side walls 55 and 56 support bearing means 57 in which are located the shafts 58 of compression rollers 59.

The shafts 54 and 58 project sufficiently beyond the wall 55 to enable sprocket wheels 59' and 60 respectively to be fixedly mounted thereon. The drive medium 48, which comprises a variable speed motor is also provided with a sprocket wheel 61 to drive sprocket wheel 59' by means of a chain 62.

Shaft 58' is provided with a second sprocket wheel 63 which is engaged by chain 62 to provide the drive for the rollers 59. The sprocket wheels 60 are meshed with a second chain 64, which is tensioned by a resiliently mounted idler sprocket 65, to complete the drive between the rollers 59.

Figure 5:
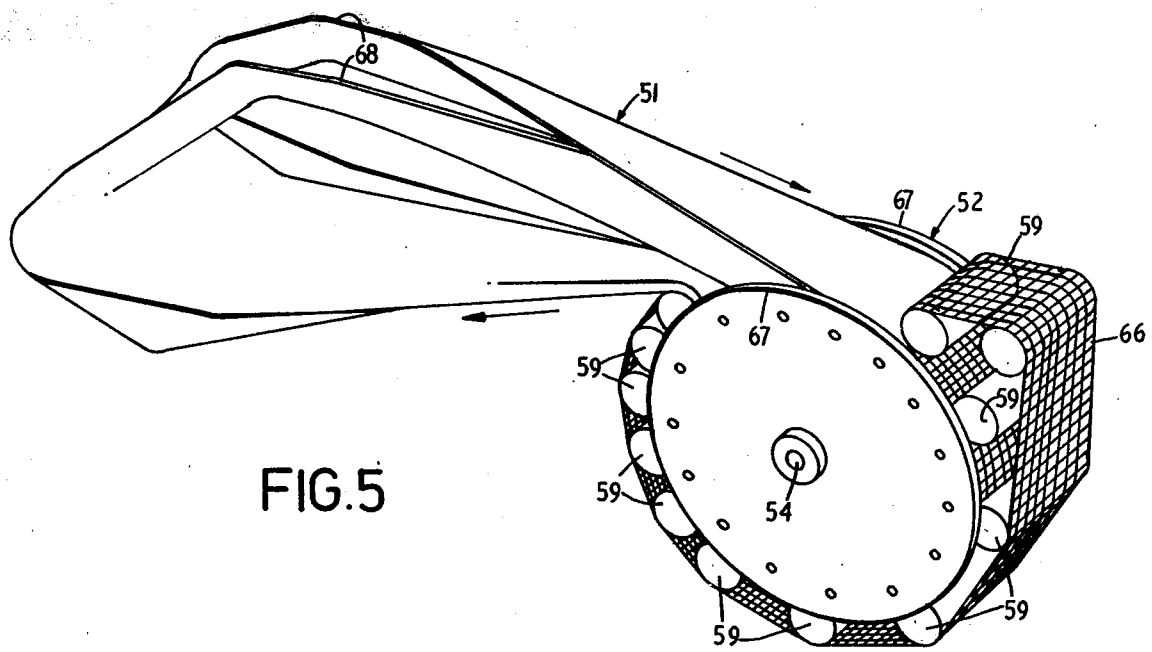
FIG. 5 is a perspective illustration showing the configuration of a conveyor according to the embodiment of FIG. 3.
Figure 6:
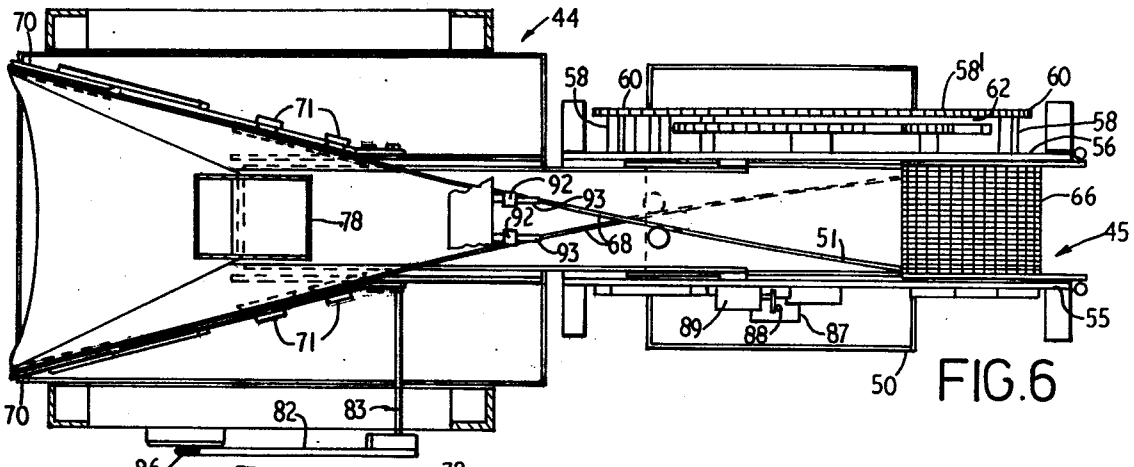
FIG. 6 is a view taken on lines 6—6 of FIG. 4.
Figure 7:
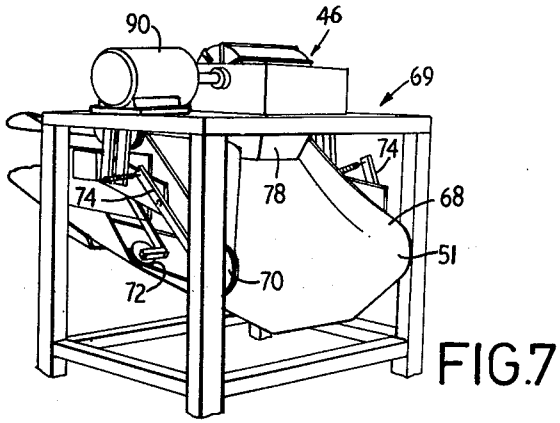
FIGS. 7 and 8 are illustrations of a part of the conveyor system showing in greater detail the conveyor guide system.

As may be seen from FIG. 5 the apparatus is provided with a second pervious belt 66 which is continuously mounted on the rollers 59 to provide a continuous pressure on belt 51. This second belt however, is not necessarily an essential feature of the invention.

As with the first embodiment the drum like member 52 is provided with flanges 67 which together with the peripheral wall 53 define a circumferential trough in which belt 51 runs. These flanges 67 are provided to guide the belt and do not otherwise perform a function.

The width of the belt 51 is at least one and one half times the width of the peripheral surface 53 and comprises a pervious material having wire reinforced edges 68. Preferably the belt 51 is between two and three times the width of the peripheral surface 53. This width however should not be greater than three times the width of the peripheral surface but preferably less.

The portion of the belt 51 located on the drum like member 52 is folded so that the edges 68 thereof overlap each other to envelop the produce and substantially prevent the pulp or residual material from escaping, as shown in FIG. 5.

Figure 8:
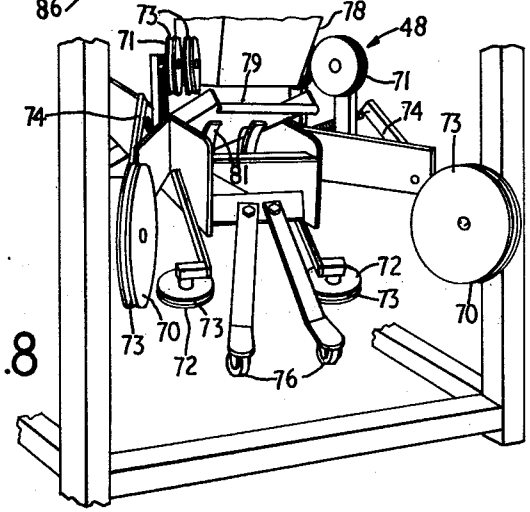

Because the belt 51 is folded to envelop the produce prior to compression thereof some means must be provided to guide the edges 68 to allow the belt to fold and unfold as it enters and leaves the compression stage. This is achieved by means of a guide assembly 69 (FIGS. 3 and 4) which is more clearly illustrated in FIGS. 6, 7 and 8.

The guide assembly 69 comprises end guide wheels 70, and upper and lower guide wheels 71 and 72 respectively. Each guide wheel 70, 71 and 72 is provided with a circumferential channel 73 in which the wire reinforced edges 68 of the belt 51 are located. As the belt 51 leaves the drum like member 52 the lower guide wheels 72 guide the edges 68 along a divergent path while end guide wheels 70 keep the edges 68 at a maximum transverse dimension as the belt turns back on itself to pass the supply source 46.

As the belt 51 is guided back past the supply source 46 the upper guide wheels guide the edges along a convergent path so that the belt forms a trough as it passes the supply source 46 so that the produce will be adequately contained.

To ensure that the belt 51 is sufficiently tensioned to retain the edges 68 in the channels of the guide wheels the end guide wheels 70 are mounted on fulcrum levers 74 which are biased by springs 75 to tighten the belt onto the guide wheels 71 and 72.

In addition to the guide wheels the apparatus is provided with stripper rollers 76 which urge the centre portion 77 (FIG. 4) of the belt in the downward direction over the station 47 to urge the residual produce pulp from the belt.

The upper guide wheels 71 are so arranged that as the centre portion 77 of the belt 51 passes under the outlet 78 of the supply source 48 it is received on a guide plate 79 which is pivotally mounted at 80. As the produce falls onto the belt 51 it deflects the guide plate 79 about the pivot 80. As the guide plate 79 pivots it engages arm like means 81 which under the influence of the weight of the produce rotates control arm 82 about pivot 83 in an anti-clockwise direction to draw control cord 84 downwardly. As the cord 84 moves down against the tension of spring 85 it rotates control wheel 86. The condition of the produce deposited on the belt 51 controls the amount of deflection of the control arm 82 which in turn controls the rotational movement of control wheel 86. The control wheel 86 sets a potentiometer or reostat which in turn controls the operational speed of drive motor 48 thereby controlling the quantity of produce deposited on the belt per foot of travel of the belt.

As the produce within the belt 51 is compressed between rollers 59, belt 66 and the wall 53 the natural juice squeezed from the produce drains downwardly through the belts 51 and 66 into a receptacle 50 in which is located a float like member 87.

Under normal circumstances the receptacle will be frequently emptied or the juice will be continuously pumped therefrom by a suitable centrifugal, vane or diaphragm pump to a remote process station. If, however, the rate at which the receptacle 50 is filled exceeds the rate at which the collected juice is removed from the receptacle it will be necessary to reduce the operational speed of the apparatus or cease operation until the receptacle is emptied or the level of the collected juice is lowered sufficiently to allow the apparatus to continue operation.

This latter operation is achieved by the float like member 87 which as it moves upwardly with the level of the juice in the receptacle pushes control rod 88 upwardly to operate control unit 89.

Control unit 89 may comprise an isolator switch operable to cut out motor 48 (FIG. 4), produce cutter motor 90 (FIG. 7) and the drive motor of a supply conveyor 91 (FIG. 4) until the level of the juice in the receptacle is lowered. Alternatively the control unit 89 may comprise a speed control unit for controlling the operational speed of the three described motors thereby controlling the rate of production with respect to the rate at which the juice is removed from the receptacle 50.

As the belt 51 leaves the drum like member 52 it passes in a downward direction over the last of the rollers 59 while the edges 68 thereof assume a divergent path of travel thereby opening the belt and allowing the pulped produce to drop into the residual collector 47. This collector may comprise a container or a suitable conveyor with the residual material being removed by pumps or the conveyor to a remote disposal point.

It will of course be appreciated that the produce source is substantially the same as the source of the first form of the invention while the conveyor 91 may be any suitable type of conveyor.

In the event that the reinforced edges 68 of the belt 51 come off the guide wheels the drive motors will be isolated by means of isolator switches 92 which sense the correct tension of the belt edges 68 by means of arms 93.

What I claim is:

1. A juice extractor apparatus comprising a liquid pervious continuous belt conveyor having a circumferential juice extractor run, a generally level upper run extending upstream from the circumferential juice extractor run and leading substantially tangentially to the top of the circumferential run and a lower generally level run below the upper run in spaced relation thereto and leading away from said circumferential run near the top thereof, means for continuously supplying to the upper run at a point spaced substantially from the circumferential run produce from which juice is to be extracted, a juice collection receptacle disposed at the bottom of the circumferential juice extractor run, a pulp collection receptacle disposed beneath the lower run and spaced laterally of said circumferential run and juice collection receptacle, means connected with said continuous belt conveyor for driving it in one direction, means on the apparatus and engaging said upper run of the belt conveyor to fold said upper run upwardly and inwardly upon itself during its approach to the top of the circumferential extractor run so that the folded belt conveyor surrounds and encloses produce deposited on it, additional means on the apparatus and engaging said lower run of the belt conveyor to unfold said lower run as it is moving away from said circumferential juice extractor run and above said pulp collection receptacle, said juice extractor apparatus further comprising a rotatable drum inside of said circumferential juice extractor run and having a channeled rim shaped and sized to receive the folded belt conveyor enclosing the produce during passage of the belt conveyor around said drum, rollers disposed in spaced relationship around the drum for a major part of the circumference of the drum and engaging the folded belt conveyor to compress its contents, means for rotationally driving said drum and said rollers, said means for unfolding the belt conveyor comprising two guide wheels above and adjacent to said lower run and between the belt conveyor longitudinal edges and being laterally spaced to engage such edges and guide them along divergent paths, said belt folding means comprising at least one pair of guide wheels with the wheels of said pair disposed outwardly of the belt edges and between the ends of said upper run and at a lateral spacing substantially less than the normal belt width and engaging the belt edges and guiding them along convergent paths, said extractor apparatus further comprising stripper means adjacent to the belt unfolding means and engaging the upper surface of the lower run of the belt approximately centrally of the belt width to force the belt downwardly adjacent to said pulp collection receptacle, means operable in response to the amount of produce deposited on said upper run per foot of belt to maintain that amount of produce between preestablished limits, and additional means operable in response to juice level in said juice collection receptacle to control the rate of juice extraction.

* * * * *